US010458151B1

(12) United States Patent
Shen

(10) Patent No.: US 10,458,151 B1
(45) Date of Patent: Oct. 29, 2019

(54) METHOD FOR SIMULTANEOUSLY CONTROLLING A PLURALITY OF DOOR LOCKS UNDER EMERGENCY

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 16/149,286

(22) Filed: Oct. 2, 2018

(30) Foreign Application Priority Data

Aug. 31, 2018 (TW) ..... 107130641

(51) Int. Cl.
*E05B 45/06* (2006.01)
*E05B 47/00* (2006.01)
*G07C 9/00* (2006.01)

(52) U.S. Cl.
CPC ..... *E05B 45/06* (2013.01); *E05B 47/00* (2013.01); *G07C 9/00571* (2013.01); *E05B 2047/005* (2013.01); *E05B 2047/0086* (2013.01); *E05Y 2900/132* (2013.01)

(58) Field of Classification Search
CPC .... E05B 45/06; E05B 47/00; E05B 2047/005; E05B 2047/0086; G07C 9/00571; E05Y 2900/132
See application file for complete search history.

(56) References Cited

U.S. PATENT DOCUMENTS

2002/0180582 A1* 12/2002 Nielsen ..... G07C 9/00103 340/5.6
2007/0204665 A1* 9/2007 Lie-Nielsen ..... E05B 47/0676 70/472
2008/0066506 A1* 3/2008 Carbajal ..... A47F 3/043 70/267
2016/0360020 A1* 12/2016 Shen ..... H04M 1/7253

* cited by examiner

*Primary Examiner* — Sisay Yacob
(74) *Attorney, Agent, or Firm* — Alan D. Kamrath; Mayer & Williams PC

(57) ABSTRACT

A method for simultaneously controlling a plurality of door locks under emergency includes utilizing a control device to connect with the door locks. The control device simultaneously set the door locks to a locking state or an unlocked state through physical connection with or disconnection from an unlocking device. When the unlocking device is removed, the control device enters a first priority emergency state, such that all door locks are set to the locking state and lose unlocking authority. A computer or a smart mobile device can be used to set a second priority emergency state when the unlocking device is identified as being correct, such that all door locks are set to the locking state and lose the unlocking authority. One or more door locks within a certain range can be set by a remote controller into the locking state and lose the unlocking authority.

6 Claims, 2 Drawing Sheets

METHOD FOR SIMULTANEOUSLY CONTROLLING A PLURALITY OF DOOR LOCKS UNDER EMERGENCY

BACKGROUND OF THE INVENTION

The present invention relates to a method for simultaneously controlling a plurality of door locks under emergency and, more particularly, to a method for simultaneously locking a plurality of door locks and simultaneously revoking the unlocking authorities of the plurality of locks.

There are various types of door locks available in the market, including mechanical locks and electronic locks incorporating motors, electromagnetic valves, and electronic parts. These door locks can be locked or unlocked separately. When the door locks are operated to be in a locking state while the door is closed, the door cannot move from the closed position to the open position, achieving an anti-burglar function.

When the door locks are used in a unit having many rooms, there is no guarantee that the door locks can reliably prevent burglars from breaking into the rooms. For example, in a school having a plurality of classrooms each having its own door and its own door lock, it is difficult to make sure the door of every classroom is locked after class. Furthermore, it is impossible to lock the door of every classroom in the school immediately after a security event occurs to prevent entry of the burglars, nor can the school report to the police at the first moment. In another example of a large company having a plurality of offices each having a door and a door lock, it is difficult to lock all offices at the same time. As a result, the school or the large company has to hire a person to check whether every door is locked. Furthermore, when a fire occurs, the doors nearby the fire cannot be closed in time.

BRIEF SUMMARY OF THE INVENTION

A method for simultaneously controlling a plurality of door locks under emergency according to the present invention includes:

connecting the plurality of door locks with a control device, with the control device obtaining control authority of each of the plurality of door locks;

physically and removably connecting an unlocking device with the control device, with the control device identifying the unlocking device, wherein the control device actuates and sets all of the plurality of door locks to a locking state when the unlocking device is identified as being incorrect, and wherein each of all of the plurality of door locks obtains unlocking authority when the unlocking device is identified as being correct;

simultaneously setting all of the plurality of door locks connected to the control device into the locking state when the unlocking device is physically removed from the control device, and the control device enters a first priority emergency state, wherein all of the plurality of door locks lose the unlocking authority and are incapable of being unlocked independently;

sending a first-class report to a police system after all of the plurality of door locks have lost the unlocking authority;

physically reconnecting the unlocking device with the control device, with the control device re-identifying the unlocking device, wherein all of the plurality of door locks remain in the locking state and lose the unlocking authority when the unlocking device is re-identified by the control device as being incorrect;

logging in a backstage with a computer or a smart mobile device with a preset account and a password to connect with the control device when the unlocking device is re-identified by the control device as being correct;

selectively lifting or not lifting the first priority emergency state after logging in the backstage, wherein all of the plurality of door locks set in the locking state remain in losing the unlocking authority when the first priority emergency state is not lifted, and wherein all of the plurality of door locks set in the locking state restore the unlocking authority and a locking authority and are capable of being operated independently when the first priority emergency state is lifted while the unlocking device is re-identified by the control device as being correct;

selectively setting or not setting a second priority emergency state after logging in the backstage while the unlocking device is physically connected to the control device, wherein all of the plurality of door locks retain respective unlocking authority when the second priority emergency state is not set, and wherein all of the plurality of door locks are set to the locking state and lose the unlocking authority when the second priority emergency state is set;

sending a second-level report to the police system when the second priority emergency state is set and all of the plurality of the door locks are set to the locking state;

selectively lifting or not lifting the second priority emergency state after logging in the backstage while the unlocking device is connected to the control device, wherein all of the plurality of door locks restore the unlocking authority when the second priority emergency state is lifted, and wherein all of the plurality of door locks lose the unlocking authority when the second priority emergency state is not lifted.

In the method according to the present invention, the first priority emergency state is entered when the unlocking device is physically detached from the control device, such that all door locks are set to the locking state and lose the unlocking authority. This can be applied in places like schools or government authorities to enable a rapid response when an emergency event occurs. For example, when an intruder intrudes a school, all door locks are set to the locking state by entering the first priority emergency state, effectively hindering the intruder. When the unlocking device is identified as being correct, the computer or the smart mobile device can be used to log in the backstage for setting the second priority emergency state, simultaneously setting all door locks to the locking state and revoking the unlocking authority of all door locks. Thus, even though the manager is not near the control device and cannot physically detach the connector of the control device from the unlocking device in time, the manager can still remotely control all door locks to the locking state.

In an example, the method further includes:

connecting the control device with a fire detection device, wherein each of the plurality of door locks retains the respective unlocking authority when the fire detection device detects no presence of a fire, and wherein the control device sets a portion of the plurality of door locks nearby the fire into the locking state when the fire detection device detects the presence of a fire, wherein the portion of the plurality of door locks lose the unlocking authority, wherein the control device enters a fire control state, and wherein the fire is reported to a fire system through a fire-reporting device connected to the control device; and selectively lifting or not lifting the fire control state, wherein the portion of the plurality of door locks set in the locking state owing to the fire lose the unlocking authority when the fire control state is not lifted, and the portion of the plurality of door locks set in the state owing to the fire restores the unlocking authority when the fire control state is lifted after logging in the backstage while the unlocking device is connected to the control device.

In an example, the method further includes:

selectively setting or not setting a third-level emergency state, wherein the third-level emergency state is set by using a remote controller to remotely set at least one of the plurality of door locks in an area into a locking state, and the at least one of the plurality of door locks loses the unlocking authority, wherein all of the plurality of door locks retain the unlocking authority when the third-level emergency state is not set;

reporting to the police system after the third-level emergency state is set; and selectively lifting or not lifting the third-level emergency state after using the computer or the smart mobile device to log in the backstage while the unlocking device is identified as being correct, wherein the at least one of the plurality of door locks set in the locking state remains in loss of the unlocking authority when the third-level emergency state is not lifted, and wherein the at least one of the plurality of door locks set in the locking state restores the unlocking authority when the third-level emergency state is lifted.

In an example, each of the plurality of door locks includes an indicating device, and each indicating device sends out an emergency alarm signal when one of the first emergency state, the second emergency state, and the third emergency state is entered.

In an example, each of the plurality of door locks includes an indicating device, wherein each indicating device sends out an emergency alarm signal when the fire control state is entered.

The present invention will become clearer in light of the following detailed description of illustrative embodiments of this invention described in connection with the drawings.

DETAILED DESCRIPTION OF THE INVENTION

Figure 1:
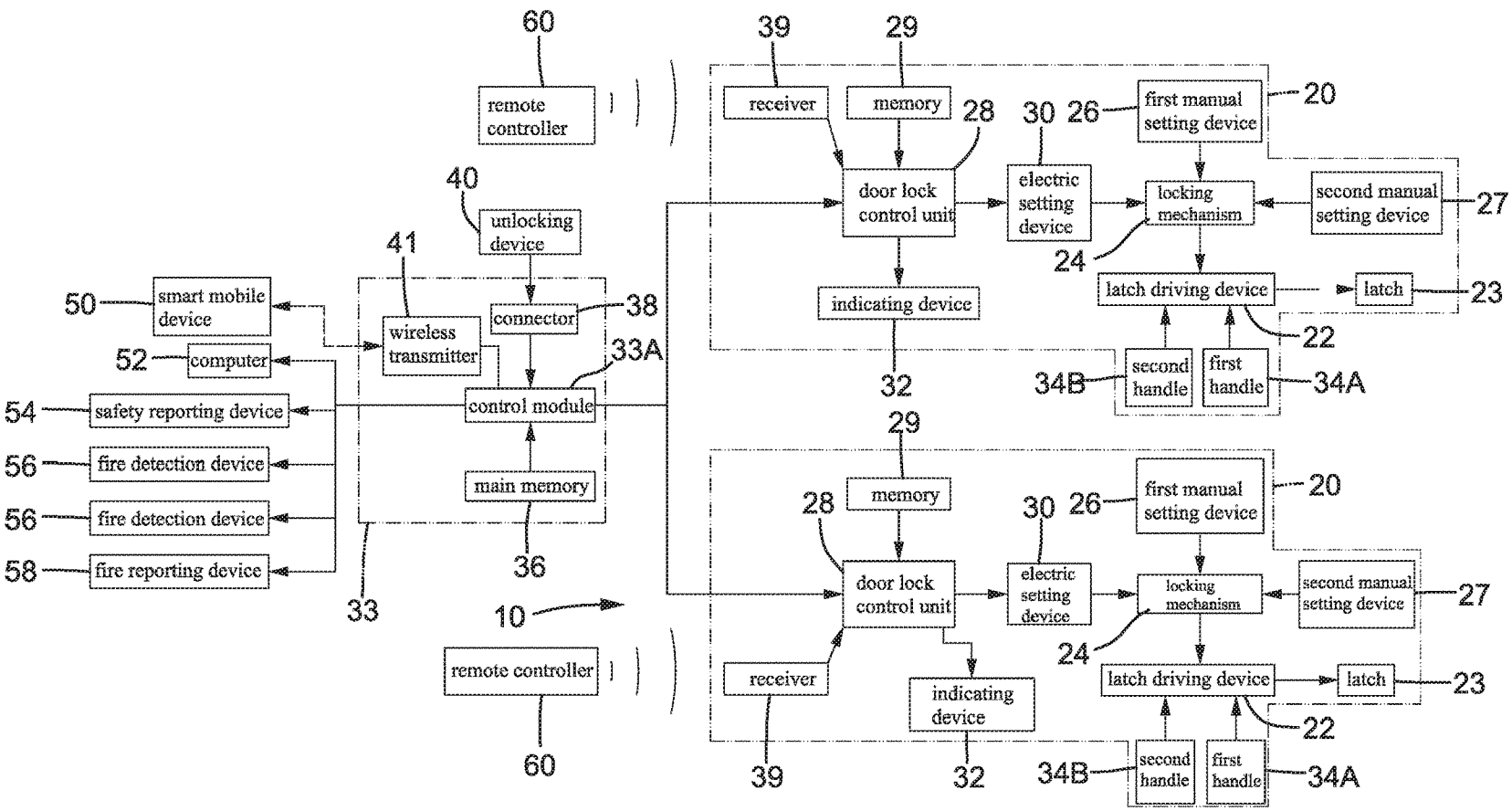
FIG. 1 is a diagrammatic block diagram of a central door access control system capable of carrying out a method for simultaneously controlling a plurality of door locks under emergency according to the present invention.
Figure 2:
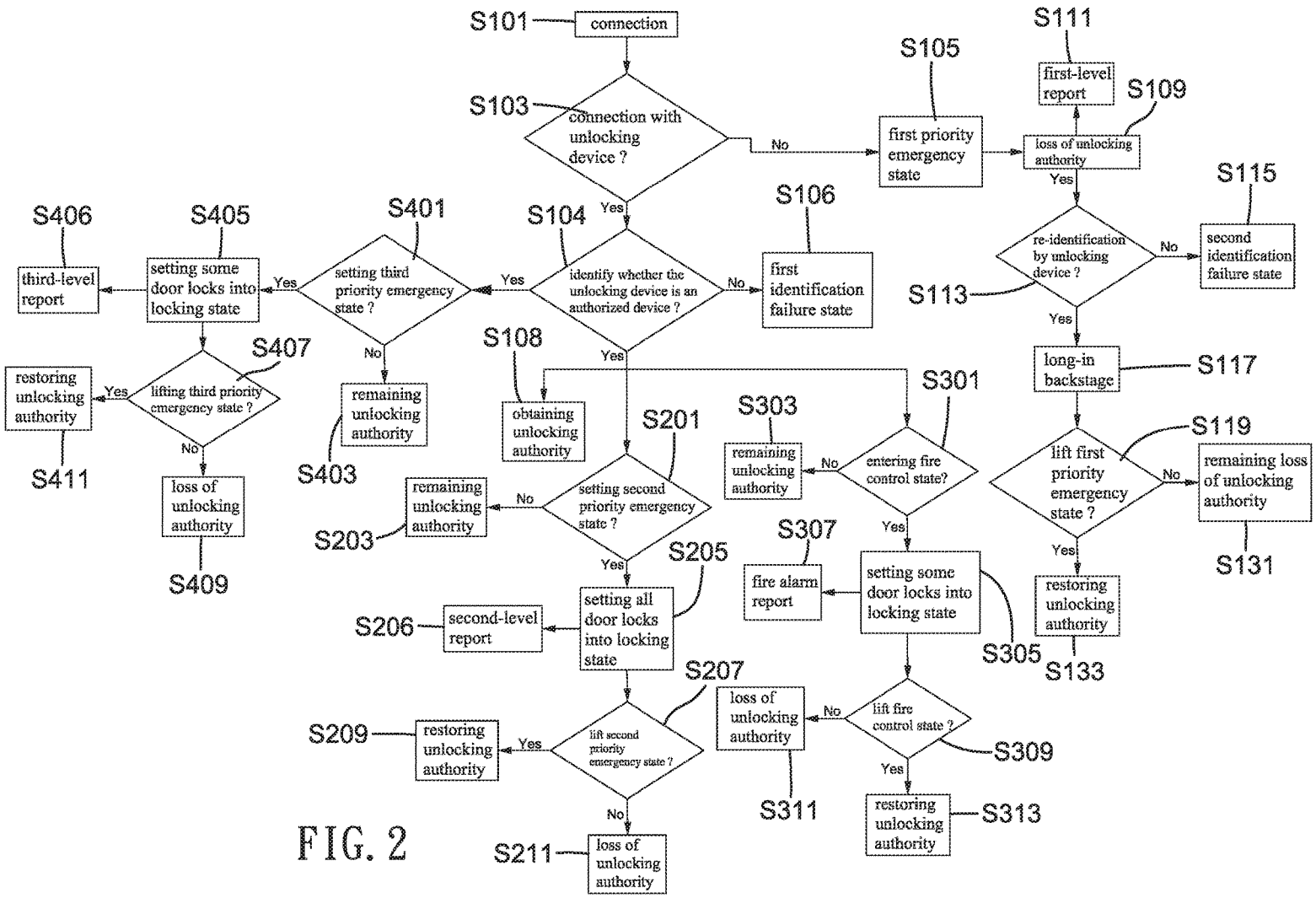
FIG. 2 is a diagrammatic flowchart illustrating operation of the method for simultaneously controlling a plurality of door locks under emergency according to the present invention.

FIG. 1 shows a diagrammatic block diagram of a central door access control system 10 capable of carrying out a method for simultaneously controlling a plurality of door locks under emergency according to the present invention. The central access control system 10 includes a plurality of door locks 20 mounted on a plurality of doors. Each door is mounted in a passage to a space, such as a classroom.

Each of the plurality of door locks 20 includes a latch driving device 22 and a latch 23 actuatable by the latch driving device 22 to move between a latching position and an unlatching position. Each of the plurality of door locks 20 further includes a locking mechanism 24 for prohibiting operation of latch driving device 22, a first manual setting device 26, a second manual setting device 27, an electric setting device 30, a door lock control unit 28 electrically connected to electric setting device 30, and an indicating device 32. The first and second manual setting devices 26 and 27 and the electric setting device 30 are configured to set the locking mechanism 24 to be in a locking state or an unlocked state. Each indicating device 32 can include a lighting member capable of generating a green light and a red light and/or a speaker or a buzzer for generating sound. Each indicating device 32 is mounted to an inner side of a respective door. Each door lock 20 further includes a memory 29 electrically connected to the door lock control unit 28.

The first manual setting device 26 of each of the plurality of door locks 20 is mounted to the inner side of a respective door. The second manual setting device 27 of each of the plurality of door locks 20 is mounted to an outer side of a respective door. The first and second manual setting devices 26 and 27 can be key cylinders of any desired form as conventional including but not limited to of a commercially available type. A key can be used to release the locking state of the first manual setting device 26 or the second manual setting device 27. Thus, the locking mechanism 24 can be set to the locking state or the unlocked state. Each of the plurality of door locks 20 further includes a first handle 34A mounted to the outer side of the respective door and operatively connected to the latch driving device 22. Each of the plurality of door docks 20 further includes a second handle 34B mounted to the inner side of the respective door and operatively connected to the latch driving device 22. The electric setting device 30 is also used to set the locking mechanism 24 to the locking state or the unlocked state. In a case that the locking mechanism 24 is set to the locking state by the electric setting device 30, it is impossible to set the locking mechanism 24 to the unlocked state by the first manual setting device 26 or the second manual setting device 27. Nevertheless, when the locking mechanism 24 is set to the unlocked state by the electric setting device 30, the locking mechanism 24 can be set to the locking state or the unlocked state by the first manual setting device 26 or the second manual setting device 27. Furthermore, when the locking mechanism 24 is set to the locking state by the first manual setting device 26 or the second manual setting device 27, the latch 23 cannot move to the unlatching position by operating the first handle 34A or the second handle 34B. On the other hand, when the locking mechanism 24 is set to the unlocked state by the electric setting device 30 and the first manual setting device 26 (or the second manual setting device 27), the latch 23 can move to the unlatching position by operating the first handle 34A or the second handle 34B, permitting subsequent opening of the respective door.

The central access control system 10 further includes a remote controller 60. Each of the plurality of door locks 20 further includes a receiver 39 electrically connected to the door lock control unit 28. The remote controller 60 and the receivers 39 can be operated to set at least one of the plurality of door locks 20 into the locked state within a predetermined range.

The central access control system 10 further includes a control device 33 having a control module 33A, a main memory 36 electrically connected to the control module 33A, a connector 38 electrically connected to the control module 33A, and a wireless transmitter 41 electrically connected to the control module 33A. The connector 38 can include an elongated slot receiving electrodes. The control module 33A is electrically connected to the door lock control units 28 of the plurality of door locks 20. The main memory 36 stores a comparison identification information corresponding to an enabling identification information of an unlocking device 40.

The central access control system 10 further includes a safety reporting device 54 electrically connected to the control module 33A of the control device 33, a plurality of fire detection devices 56 electrically connected to the control module 33A, and a fire reporting device 58 electrically connected to the control module 33A. The plurality of fire detection devices 56 is disposed in various places of a building to detect whether a fire occurs and to report the fire to the control module 33A. The fire reporting device 58 is connected to a fire system to inform the fire. The central access control system 10 further includes a computer 52 connected to the control device 33 and a smart mobile device 50 connected to the control device 33. The smart mobile device 50 can be connected to the control device 33 via the wireless transmitter 41 to a "backstage" (a software interface only accessible to a manager).

The control device 33 is configured to match with the unlocking device 40. The unlocking device 40 can be a door access card and is configured to control the control device 33. A comparison identification information corresponding to the enabling identification information of the unlocking device 40 is stored in the memory 29 of each of the plurality of door locks 20. An emergency state identification information is stored in the remote controller 60. When the remote controller 60 is used to set the plurality of door locks 20 to the locking state, the emergency state identification information received by a respective door lock 20 is compared with the comparison identification information in the respective memory 29. When the emergency state identification information is identified as being correct, the respective door lock 20 receiving the emergency state identification information from the remote controller 60 will be set to the locking state and will lose the unlocking authority.

In an example of carrying out the method for simultaneously controlling a plurality of door locks under emergency according to the present invention using the central access control system 10, for the sake of explanation, it will be assumed that each door is closed and the latches 23 are in the latching position. Firstly, the method includes establishing a connection between the plurality of door locks 20 and the control device 30 (step S101), such that the control device 30 obtains the control authority of the plurality of door locks 20. Specifically, the control device 30 obtains the control authority of the electric setting device 30 of each of the plurality of door locks 20. Furthermore, the control device 33 can set a specific one, several of, or all the locking mechanism 24 of all door locks 20 to the locking state or the unlocked state at the same time.

Next, the unlocking device 40 is physically and removably connected to the control device 33 (step S103). As an example of the physical and removable connection, the unlocking device 40 in the form of a card is inserted into the control device 33 to be electrically connected to the connector 38, such that the control device 33 can read the enabling identification information in the unlocking device 40.

Next, the control device 33 identifies whether the unlocking device 40 is an authorized device (step S104). Specifically, the control device 33 compares the enabling identification information in the unlocking device 40 with the comparison identification information in the main memory 36. When the control device 33 identifies the enabling identification information in the unlocking device 40 does not match with the comparison identification information in the main memory 36 (the unlocking device 40 is identified as being incorrect), the control device 33 enters a first identification failure state (S106), and the control device 33 controls the electric setting devices 30 of the plurality of door locks 20 to set the locking mechanisms 24 of the plurality of door locks 24 to the locking state without activating the safety reporting device 54. Thus, all door locks 20 lose their independent operation authority. Namely, neither of the first and second manual setting devices 26 and 27 of any of the plurality of door locks 20 can be independently operated for setting the respective locking mechanism 24 to the unlocked state. As a result, all doors are closed with their latches 23 in the latching position, preventing opening of the doors.

On the other hand, when the control device 33 identifies that the enabling identification information in the unlocking device 40 matches with the comparison identification information in the main memory 36 (the unlocking device 40 is identified as being correct), the plurality of door locks 20 obtains independent operation authority (S108). Namely, each and every of the plurality of door locks 20 can operate independently. Specifically, the control device 33 actuates none of the electric setting devise 30 of the plurality of door locks 20, such that the locking mechanisms 24 of the plurality of door locks 20 remain in their original states (the locking state or unlocked state set by the first manual setting device 26 or the second manual setting device 27). Furthermore, each of the plurality of door locks 20 permits use of the first manual setting device 26 or the second manual setting device 27 to set the respective locking mechanism 24 to the locking state or unlocked state. Furthermore, each of the plurality of door locks 20 set in the locked state allows operation of the respective first handle 34A or the respective second handle 34B to actuate the respective latch driving device 22 to thereby retract the respective latch 23 to the unlatching position.

When the unlocking device 40 is physically removed from the control device 33, all door locks 20 connected to the control device 33 are set to the locking state and are locked, which is the first priority emergency state S105. Specially, after the enabling identification information in the unlocking device 40 is identifies as being correct, if the unlocking device 40 is directly removed from the connector 38 of the control device 33, the control device 33 will enter the first priority emergency state S105, and the electric setting devices 30 of all door locks 20 are actuated by the control device 33 to set the locking mechanisms 24 of all door locks 20 to the locking state, such that the unlocking authority of all door locks 20 is revoked (S109). In this case, each door cannot be operated to set the respective locking mechanism 24 to the unlocked state by inserting a key to operate the first manual setting device 26 or the second manual setting device 26. Thus, the door cannot be opened by the first handle 34A or the second handle 34B. Namely, without physical connection between the unlocking device 40 and the control device 33, all door locks 20 lose the unlocking authority (S109) and cannot be independently operated to the unlocked state. This achieves a control function of avoiding easy, simultaneous opening of all doors. Furthermore, after the control device 33 enters the first priority emergency state S105, the indicating devices 32 of all door locks 20 send out an emergent alarm signal.

After all door locks 20 have lost their unlocking authority, a first-level report is sent out to a police system (step S111). Specifically, after the unlocking device 40 has been physically removed from the connector 38 of the control device 33 and all door locks 20 have lost the unlocking authority, the control device 33 actuates the safety reporting device 54 to inform the police system of the emergency event (such as intrusion of an intruder into the school).

When the unlocking device 40 is physically reconnected to the control device 33, the control device 33 re-identifies whether the unlocking device 40 is correct (step S113). After the emergency event has been solved (e.g., the intruder has been arrested), the unlocking device 40 can be reconnected to the connector 38 of the control device 33 to enable the control device 33 to read the enabling identification information in the unlocking device 40.

When the control device 33 re-identifies again that the unlocking device 40 as being incorrect, all door locks 20 are set to lose the unlocking authority (S115). Specifically, after the emergency event has been solved and the unlocking device 40 has been reconnected to the control device 33, when the control device 33 identifies the enabling identification information as being incorrect, the control device 33 enters a second identification failure state S115. All door locks 20 remain in the locking state and lose the unlocking authority.

When the control device 33 identifies the unlocking device 40 as being correct in step S113, a computer 52 or a smart mobile device 50 can be utilized to log in the backstage (using a preset account and a password) for connection with the control device 33 (step S117). After log-in of the backstage, the manager can select whether to lift the first priority emergency state (S119). Namely, after log-in of the backstage, when the first priority emergency state S105 is not lifted, all door locks 20 set in the locked state remain in the unlocking authority-revoked state (S131). On the other hand, after log-in of the backstage and after the control device 33 identifies the unlocking device 40 as being correct, when the first priority emergency state S105 is lifted, all door locks 20 set in the locking state restores the authority of independent locking and independent unlocking (S133).

It is noted that after the first priority emergency state S105 is entered, even though the emergency event has been solved and the control device 33 identifies the unlocking device 40 as being correct, none of the door locks 20 is granted the unlocking authority. Specifically, all door locks 20 obtain the unlocking authority only after the unlocking device 40 is identified as being correct and the first priority emergency state S105 is lifted after the manager logs in the backstage and lifts the first priority emergency state S105. After the unlocking authority is granted, the locking mechanism 24 of each of the plurality of door locks 20 can be set to the locking state or unlocked state through the first manual setting device 26 or the second manual setting device 27.

It is further noted that restoring the unlocking authority can be so set that all door locks 20 restore their states before entering the first priority emergency state S105. For example, in a case that a portion of all door locks 20 are independently set into the locking state and that the remaining portion of all door locks 20 are independently set into the unlocked state, after the first priority emergency state is lifted, the portion of all door locks 20 set into the locking state remains in the locking state but can be independently operated for unlocking purposes. Furthermore, after the first priority emergency state is lifted, the remaining portion of all door locks 20 set into the unlocked state restores the unlocked state and can be independently operated for locking purposes.

After the unlocking device 40 has been physically connected to the control device 33 and after log-in of the backstage, a second priority emergency state can be set (step S201). When the second priority emergency state is not set, all door locks 20 remain the unlocking authority (S203). When the second priority emergency state is set, all door locks 20 are set into the locking state S205 and lose the unlocking authority. After the unlocking device 40 is identified correct and the manager has logged-in the backstage by the computer 52 or the smart mobile device 50, the manager can use an interface of the backstage to select whether to set the second priority emergency state. For example, in a case that an intruder intrudes the school while the manager is away from the control device 33 and, thus, cannot physically detach the unlocking device 40 from the control device 33, the manager can use the smart mobile device 50 to log in the backstage, and an icon representing the second priority emergency state (S201) can be pressed, such that the control device 33 sets the locking mechanisms 24 of all door locks 20 to the locked state while the control device 33 is physically connected to the unlocking device 40 and identifies the unlocking device 40 as being correct. Thus, all door locks 20 lose the unlocking authority. After the second priority emergency state is entered, the indicating device 32 of each of the plurality of door locks 20 sends out an emergency alarm signal.

While the second priority emergency state (S201) is entered, the control device 33 sends out a second-level report S206. After the second priority emergency state is set and all door locks 20 are set to the locking state, the status is reported to the police system. Specifically, the control device 33 activates the safety reporting device 54 to inform the police system of the emergency event (such as intrusion by an intruder into the school).

After log-in of the backstage while the unlocking device 40 is connected to the control device 33, the second priority emergency state can be optionally lifted (step S207). When the second priority emergency state is lifted, all door locks 20 restore the unlocking authority (S209). On the other hand, when the second priority emergency state is not lifted, all door locks 20 remain in the unlocking authority-revoked state. Specifically, after the emergency event has been solved (e.g., the intruder has been arrested) and the unlocking device 40 is identified as being correct, an icon (on the interface of the backstage) representing lifting the second priority emergency state can be pressed. Thus, all door lock 20 restore the unlocking authority (S209). If the icon representing lifting the second priority emergency state is not pressed, all door locks 20 remain in the unlocking authority-revoked state (S211).

It is noted that when the second priority emergency state is entered and the unlocking device is physically removed from the connector 38 of the control device 330, the control device 33 enters the first priority emergency state S105. Thus, even though the computer 52 or the smart mobile device 50 is utilized to log in the backstage and an icon is pressed to lift the first priority emergency state or the second priority emergency state, none of the door locks 20 restore the unlocking authority. Thus, even a robber robs the manager of the computer 52 or the smart mobile device 50, the robber cannot utilize the computer 52 or the smart mobile device 50 to restore the unlocking authority.

It is further noted that restoring the unlocking authority can be so set that all door locks 20 restore their states before entering the second priority emergency state S105. For example, in a case that a portion of all door locks 20 are independently set into the locking state and that the remaining portion of all door locks 20 are independently set into the unlocked state, after the second priority emergency state is lifted, the portion of all door locks 20 set into the locking state remains in the locking state but can be independently operated for unlocking purposes. Furthermore, after the second priority emergency state is lifted, the remaining portion of all door locks 20 set into the unlocked state restores the unlocked state and can be independently operated for locking purposes.

The method for simultaneously controlling a plurality of door locks under emergency according to the present invention further includes whether to enter a fire control state S301. When none of the fire detection devices 56 connected to the control device 33 detect a fire, each of the plurality of door locks retains its unlocking authority S303. When one of the plurality of fire detection devices 56 detects a fire, the control device 33 controls a portion of the plurality of door locks 20 associated with the position of the one of the plurality of fire detection devices 56 detecting the fire and revoking the unlocking authority of the portion of the plurality of door locks 20. Specifically, the plurality of fire detection devices 56 can be disposed in proper locations in a building. When one of the plurality of fire detection devices 56 detects a fire, the control device 33 automatically sets a portion of the plurality of door locks 20 associated with the position of the one of the plurality of fire detection devices 56 to the locking state. Thus, the associated doors cannot be opened to reduce the spreading speed of the fire. Furthermore, the control device 33 sends out a fire alarm report (S307). Namely, after a fire control state is entered, the control device 33 uses the fire reporting device 58 to report the fire to the fire system, and the firemen can arrive at the fire site at the first moment to extinguish the fire.

Next, the fire control state can be lifted (S309). If the fire control state is not lifted, the portion of the plurality of door locks 20 set to the locking state owing to the fire loses the unlocking authority (S311). After log-in of the backstage while the unlocking device 40 is connected to the control device 33, the fire control state can be optionally lifted to restore the unlocking authority (S313). Specifically, after the fire has been put out, the manager can log in the backstage while the unlocking device 40 is physically connected to the connector 38 of the control device 33 and is identified as being correct. Then, the manager can press an icon representing lifting of the fire control state, such that the portion of the plurality of door locks 20 set to the locking state owing to the fire restores the unlocking authority (S311). On the other hand, when manager does not press the icon representing lifting of the fire control state, the portion of the plurality of door locks 20 set to the locking state owing to the fire remains in the unlocking authority-revoked state (S311).

It is further noted that restoring the unlocking authority can be so set that all door locks 20 restore their states before entering the fire control state S105. For example, in a case that a portion of all door locks 20 are independently set into the locking state and that the remaining portion of all door locks 20 are independently set into the unlocked state, after the fire control state is lifted, the portion of all door locks 20 set into the locking state remains in the locking state but can be independently operated for unlocking purposes. Furthermore, after the fire control state is lifted, the remaining portion of all door locks 20 set into the unlocked state restores the unlocked state and can be independently operated for locking purposes.

Next, a third priority emergency state can be set (S401). The remote controller 60 can be used to remotely set at least one of the plurality of door locks 20 to the locking state. If the third priority emergency state is not set, all door locks 20 retains the unlocking authority (S403). In a case that a portion of the plurality of door locks 20 is set to the locking state (S405), when the third priority emergency state is set, the portion of the plurality of door locks 20 set to the locking state loses the unlocking authority. Specifically, the remote controller 60 matches with the receiver 39 of each of the plurality of door locks 20. When the unlocking device 40 is identified as being correct, one or more of the plurality of door locks 20 within a certain range are set to the locking state and lose the unlocking authority (cannot be set to the unlocked state by the first manual setting device 26 or the second manual setting device 27). Furthermore, all door locks 20 send out an emergent alarm signal through the indicating devices 32. Thus, the manager in a location away from the control device 33 can set the desired door locks to the locking state under emergency. As a result, the manager can set at least one of the plurality of door locks 20 within a smaller area more quickly than setting the second priority emergency state through log-in of the backstage. Furthermore, a third-level report (S406) can be reported to the police system after setting the third priority emergency state.

Next, the third priority emergency state can be lifted (S407). Specifically, the computer 52 or the smart mobile device 50 is utilized to log in the backstage while the unlocking device 40 is identified as being correct, and lifting of the third priority emergency state can be executed. When lifting of the third priority emergency state is not executed, a portion of the plurality of door locks 20 set to the locking state remains in the unlocking authority-revoked state (S409). When the lifting of the third priority emergency state is executed, the portion of the plurality of door locks 20 set to the locking state restores the unlocking authority (S411).

In the method for simultaneously controlling a plurality of door locks under emergency according to the present invention, the first priority emergency state is entered when the unlocking device 40 is physically detached from the control device 33, such that all door locks 20 are set to the locking state and lose the unlocking authority. This can be applied in places like schools or government authorities to enable a rapid response when an emergency event occurs. For example, when an intruder intrudes a school, all door locks 20 are set to the locking state by entering the first priority emergency state, effectively hindering the intruder.

In the method for simultaneously controlling a plurality of door locks under emergency according to the present invention, when the unlocking device 40 is identified as being correct, the computer 52 or the smart mobile device 50 can be used to log in the backstage for setting the second priority emergency state, simultaneously setting all door locks 20 to the locking state and revoking the unlocking authority of all door locks 20. Thus, even though the manager is not near the control device 33 and cannot physically detach the connector 38 of the control device 33 from the unlocking device 40 in time, the manager can still remotely control all door locks 20 to the locking state.

In the method for simultaneously controlling a plurality of door locks under emergency according to the present invention, the remote controller 60 can be used to set one or more of the plurality of door locks 20 within a certain area to the locking state and to revoke the unlocking authority of the one or more of the plurality of door locks 20. Furthermore, the manager or a sub-manager having a lower managing authority can rapidly set the door locks 20 according to the actual situation.

In the method for simultaneously controlling a plurality of door locks under emergency according to the present invention, when the first, second, or third priority emergency state is entered, the control device 33 can use the safety reporting device 54 to report the emergency event (such as intrusion by an intruder) to the police system, improving the reporting efficiency.

In the method for simultaneously controlling a plurality of door locks under emergency according to the present invention, after the fire control state is entered, a portion of the door locks 20 within the fire control area can be set to the locking state and loses the unlocking authority, such that the closed doors can temporarily stop the fire from spreading. Furthermore, after the fire control state is entered, the fire system can be informed at the first moment, reducing the time for the firemen to reach the fire site.

Now that the basic teachings of the present invention have been explained, many extensions and variations will be obvious to one having ordinary skill in the art. For example, the method for simultaneously controlling a plurality of door locks under emergency according to the present invention, does not have to include the step of entering the fire control state and/or the third priority emergency state. In this case, the method according to the present invention can still simultaneously control the plurality of door locks 20 under emergency while removing their unlocking authority.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A method for simultaneously controlling a plurality of door locks under emergency, comprising:

connecting the plurality of door locks with a control device, with the control device obtaining control authority of each of the plurality of door locks;

physically and removably connecting an unlocking device with the control device, with the control device identifying the unlocking device, wherein the control device actuates and sets all of the plurality of door locks to a locking state when the unlocking device is identified as being incorrect, and wherein each of all of the plurality of door locks obtains unlocking authority when the unlocking device is identified as being correct;

simultaneously setting all of the plurality of door locks connected to the control device into the locking state when the unlocking device is physically removed from the control device, and the control device enters a first priority emergency state, wherein all of the plurality of door locks lose the unlocking authority and are incapable of being unlocked independently;

sending a first-class report to a police system after all of the plurality of door locks have lost the unlocking authority;

physically reconnecting the unlocking device with the control device, with the control device re-identifying the unlocking device, wherein all of the plurality of door locks remain in the locking state and lose the unlocking authority when the unlocking device is re-identified by the control device as being incorrect;

logging in a backstage with a computer or a smart mobile device with a preset account and a password to connect with the control device when the unlocking device is re-identified by the control device as being correct;

selectively lifting or not lifting the first priority emergency state after logging in the backstage, wherein all of the plurality of door locks set in the locking state remain in losing the unlocking authority when the first priority emergency state is not lifted, and wherein all of the plurality of door locks set in the locking state restore the unlocking authority and a locking authority and are capable of being operated independently when the first priority emergency state is lifted while the unlocking device is re-identified by the control device as being correct;

selectively setting or not setting a second priority emergency state after logging in the backstage while the unlocking device is physically connected to the control device, wherein all of the plurality of door locks retain respective unlocking authority when the second priority emergency state is not set, and wherein all of the plurality of door locks are set to the locking state and lose the unlocking authority when the second priority emergency state is set;

sending a second-level report to the police system when the second priority emergency state is set and all of the plurality of the door locks are set to the locking state;

selectively lifting or not lifting the second priority emergency state after logging in the backstage while the unlocking device is connected to the control device, wherein all of the plurality of door locks restore the unlocking authority when the second priority emergency state is lifted, and wherein all of the plurality of door locks lose the unlocking authority when the second priority emergency state is not lifted.

2. The method for simultaneously controlling the plurality of door locks under emergency as claimed in claim 1, further comprising:

connecting the control device with a fire detection device, wherein each of the plurality of door locks retains the respective unlocking authority when the fire detection device detects no presence of a fire, and wherein the control device sets a portion of the plurality of door locks nearby the fire into the locking state when the fire detection device detects the presence of a fire, wherein the portion of the plurality of door locks lose the unlocking authority, wherein the control device enters a fire control state, and wherein the fire is reported to a fire system through a fire-reporting device connected to the control device; and selectively lifting or not lifting the fire control state, wherein the portion of the plurality of door locks set in the locking state owing to the fire lose the unlocking authority when the fire control state is not lifted, and the portion of the plurality of door locks set in the state owing to the fire restores the unlocking authority when the fire control state is lifted after logging in the backstage while the unlocking device is connected to the control device.

3. The method for simultaneously controlling the plurality of door locks under emergency as claimed in claim 1, further comprising:

selectively setting or not setting a third-level emergency state, wherein the third-level emergency state is set by using a remote controller to remotely set at least one of the plurality of door locks in an area into a locking state, and the at least one of the plurality of door locks loses the unlocking authority, wherein all of the plurality of door locks retain the unlocking authority when the third-level emergency state is not set;

reporting to the police system after the third-level emergency state is set; and selectively lifting or not lifting the third-level emergency state after using the computer or the smart mobile device to log in the backstage while the unlocking device is identified as being correct, wherein the at least one of the plurality of door locks set in the locking state remains in loss of the unlocking authority when the third-level emergency state is not lifted, and wherein the at least one of the plurality of door locks set in the locking state restores the unlocking authority when the third-level emergency state is lifted.

4. The method for simultaneously controlling the plurality of door locks under emergency as claimed in claim 3, wherein each of the plurality of door locks includes an indicating device, wherein each indicating device sends out an emergency alarm signal when one of the first emergency state, the second emergency state, and the third emergency state is entered.

5. The method for simultaneously controlling the plurality of door locks under emergency as claimed in claim 1, wherein each of the plurality of door locks includes an indicating device, wherein each indicating device sends out an emergency alarm signal when one of the first emergency state and the second emergency state is entered.

6. The method for simultaneously controlling the plurality of door locks under emergency as claimed in claim 2, wherein each of the plurality of door locks includes an indicating device, wherein each indicating device sends out an emergency alarm signal when the fire control state is entered.

* * * * *